US009514877B2

(12) United States Patent
Homma et al.

(10) Patent No.: US 9,514,877 B2
(45) Date of Patent: Dec. 6, 2016

(54) AMORPHOUS CORE TRANSFORMER

(71) Applicant: Hitachi Industrial Equipment Systems Co., Ltd., Chiyoda-ku, Tokyo (JP)

(72) Inventors: Toru Homma, Tokyo (JP); Toshiaki Takahashi, Tokyo (JP); Ryosuke Mikoshiba, Tokyo (JP); Tatsunori Sato, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 14/417,209

(22) PCT Filed: Jun. 14, 2013

(86) PCT No.: PCT/JP2013/066466
§ 371 (c)(1),
(2) Date: Jan. 26, 2015

(87) PCT Pub. No.: WO2014/017212
PCT Pub. Date: Jan. 30, 2014

(65) Prior Publication Data

US 2015/0213949 A1 Jul. 30, 2015

(30) Foreign Application Priority Data

Jul. 27, 2012 (JP) ..... 2012-167160

(51) Int. Cl.
*H01F 7/06* (2006.01)
*H01F 27/30* (2006.01)
(Continued)

(52) U.S. Cl.
CPC ..... *H01F 27/32* (2013.01); *H01F 27/25* (2013.01); *H01F 27/26* (2013.01); *H01F 27/306* (2013.01);
(Continued)

(58) Field of Classification Search
CPC ..... H01F 27/32; H01F 27/26; H01F 27/324; H01F 41/0226
(Continued)

(56) References Cited

U.S. PATENT DOCUMENTS 2,511,174 A 6/1950 Osborne
5,055,815 A 10/1991 Yamamoto et al.
(Continued)

FOREIGN PATENT DOCUMENTS

JP 5-190342 A 7/1993
JP 8-22927 A 1/1996
(Continued)

OTHER PUBLICATIONS

International Search Report (PCT/ISA/210) dated Jul. 9, 2013, with English translation (Four (4) pages).
(Continued)

*Primary Examiner* — Mangtin Lian
(74) *Attorney, Agent, or Firm* — Crowell & Moring LLP

(57) ABSTRACT

During the assembly process of an amorphous core transformer, when an offset has arisen between a coil and the amorphous core, and when an offset has arisen between the coil and the core due to a shock resulting from unloading or vibrations during transport, there has been the risk of breakage of an insulating member between an amorphous core and a coil, causing amorphous fragments to be scattered. The object of the present invention is to prevent scattering of amorphous fragments. The amorphous core transformer, which results from assembling a coil and an amorphous core having a joint section, is characterized by folding an insulating member having a rectangular cylinder and flanges, inserting the folded insulating member into the hole of the coil, expanding the cylinder and the flanges of the insulating member, disconnecting the joint section of the amorphous
(Continued)

core, inserting the open-ended amorphous core into the cylinder of the insulating member placed within the coil, lapping the disconnected joint section of the amorphous core, and covering/wrapping yokes of the amorphous core with the flanges of the insulating member.

5 Claims, 9 Drawing Sheets

(51) Int. Cl.

| | |
|---|---|
| ***H01F 27/24*** | (2006.01) |
| ***H01F 27/32*** | (2006.01) |
| ***H01F 27/26*** | (2006.01) |
| ***H01F 41/02*** | (2006.01) |
| ***H01F 27/25*** | (2006.01) |

(52) U.S. Cl.
CPC ..... *H01F 27/324* (2013.01); *H01F 41/0226* (2013.01)

(58) Field of Classification Search
USPC ..... 336/55, 208, 206, 213, 221
See application file for complete search history.

(56) References Cited

U.S. PATENT DOCUMENTS

| | | | | |
|---|---|---|---|---|
| 6,005,468 | A * | 12/1999 | Shirahata | H01F 27/306 336/210 |
| 2001/0033216 | A1 | 10/2001 | Shirahata et al. | |
| 2002/0057180 | A1 * | 5/2002 | Shirahata | H01F 30/12 336/213 |
| 2013/0106555 | A1 * | 5/2013 | Kubota | H01F 41/0226 336/212 |

FOREIGN PATENT DOCUMENTS

| | | | |
|---|---|---|---|
| JP | 9-153417 | A | 6/1997 |
| JP | 11-97254 | A | 4/1999 |
| JP | 2000-82625 | A | 3/2000 |
| JP | 2003-338418 | A | 11/2003 |

OTHER PUBLICATIONS

Supplementary European Search Report issued in counterpart European Application No. 13823318.4 dated Apr. 7, 2016 (8 pages).

* cited by examiner

AMORPHOUS CORE TRANSFORMER

TECHNICAL FIELD

The present invention relates to amorphous core transformers.

BACKGROUND ART

An example of a related-art invention is Japanese Patent Application Laid-Open No. HEI05-190342 (Patent Document 1). Patent Document 1 discloses a wound core transformer and a method for fabricating the same and aims to simplify the work of covering the wound core, which is made of an amorphous magnetic alloy, and also aims to prevent the leakage of broken core fragments. The transformer disclosed therein comprises core covers having cylinders to insert legs of the wound core and flanges provided at both ends of the cylinder, and the cylinders of these core covers are inserted into the windows of a coil. The joint sections of one of the yokes of the wound core are then disconnected so that the legs of the wound core are inserted into the cylinders of the core covers. After the insertion of the wound core legs, the joint sections of the core are closed. Thereafter, the flanges of the core covers are folded to cover the yokes of the wound core.

CITATION LIST

Patent Literature

Patent Document 1: Japanese Patent Application Laid-Open No. HEI05-190342

SUMMARY OF INVENTION

Technical Problem

Patent Document 1 discloses an insulating member similar to the ones of the present invention, but it teaches neither a method for inserting the insulating member into the hole of a coil nor a method for expanding the insulating member. Besides, during the assembly process of an amorphous core transformer, in case where the core may be displaced from the coils, or in case where displacement between coils and cores occurs due to vibrations during shipment or unloading impacts, or in case where the coils are deformed or displaced due to an electromagnetic force induced by a short-circuit current, the insulating member may be broken, leading to scattering of broken fragments from the amorphous core.

The object of the present invention is to solve the above problems and provide an amorphous core transformer that prevents scattering of broken fragments from the amorphous core.

Solution to Problem

To achieve the above object, the invention provides an amorphous core transformer assembled with an amorphous core having a joint section and a coil, wherein the amorphous core transformer is formed by: folding an insulating member having flanges and a rectangular cylinder; inserting the folded insulating member into the hole of the coil; expanding the cylinder and the flanges of the insulating member; disconnecting the joint section of the amorphous core; inserting the open-ended amorphous core into the cylinder of the insulating member placed within the coil; lapping the disconnected joint section of the amorphous core; and covering the yokes of the amorphous core with the flanges of the insulating member. The above structure allows the amorphous core to be wrapped with the insulating member without the coil being touched by the amorphous core. Thus, even if the coil is displaced from the amorphous core, damage to the insulating member is less likely to occur than in conventional insulating members, thereby preventing scattering of broken fragments from the amorphous core.

Advantageous Effects of Invention

In accordance with the present invention, a more reliable amorphous core transformer than conventional ones can be provided.

DESCRIPTION OF EMBODIMENT

Embodiments of the present invention will now be described with reference to the accompanying drawings.

Example 1

FIGS. 1A through 1E illustrate the structure of an insulating member used for an amorphous core. As illustrated in the figures, the insulating member includes a rectangular cylinder 101 and two flanges 102. The insulating member is usually made of kraft paper and is about 0.25-mm thick. The cylinder 101 is made by folding an insulating sheet into the shape of a rectangular cylinder, and each of the flanges 102 is made by making an x-shaped cut at the center of a rectangular insulating sheet such that the cut fits within the opening of the cylinder 101. The flanges 102 are stuck to the both ends of the cylinder 101 such that no clearance is present at joint sections in both ends.

An amorphous core is to be inserted into the cylinder 101 made of the insulating member. The x-shaped flange provided at the cylinder end through which to insert the amorphous core forms triangular flaps. The triangular flaps are then stuck and adhered to the inner surfaces of the cylinder 101. On the other hand, the other triangle flaps formed at the cylinder end from which the amorphous core comes out are stuck and adhered to the outer surfaces of the cylinder 101. Thus, the triangle flaps formed by cutting the flanges 102 are stuck and adhered at both ends of the cylinder, which allows the amorphous core to be inserted smoothly without getting stuck, thus preventing damage to the insulating member.

Figure 1A:
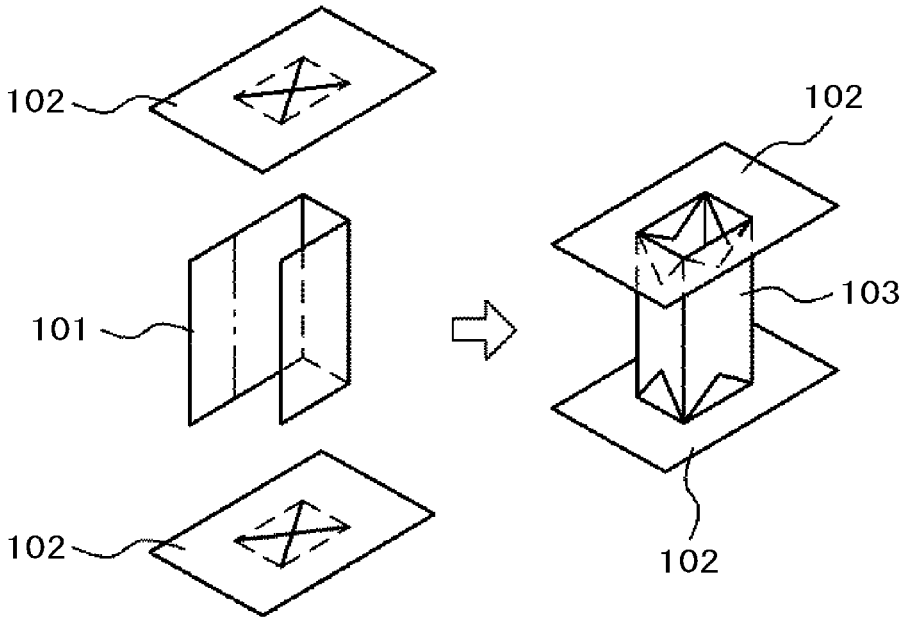
FIG. 1A illustrates a structure of an insulating member according to Example 1 of the present invention.
Figure 1B:
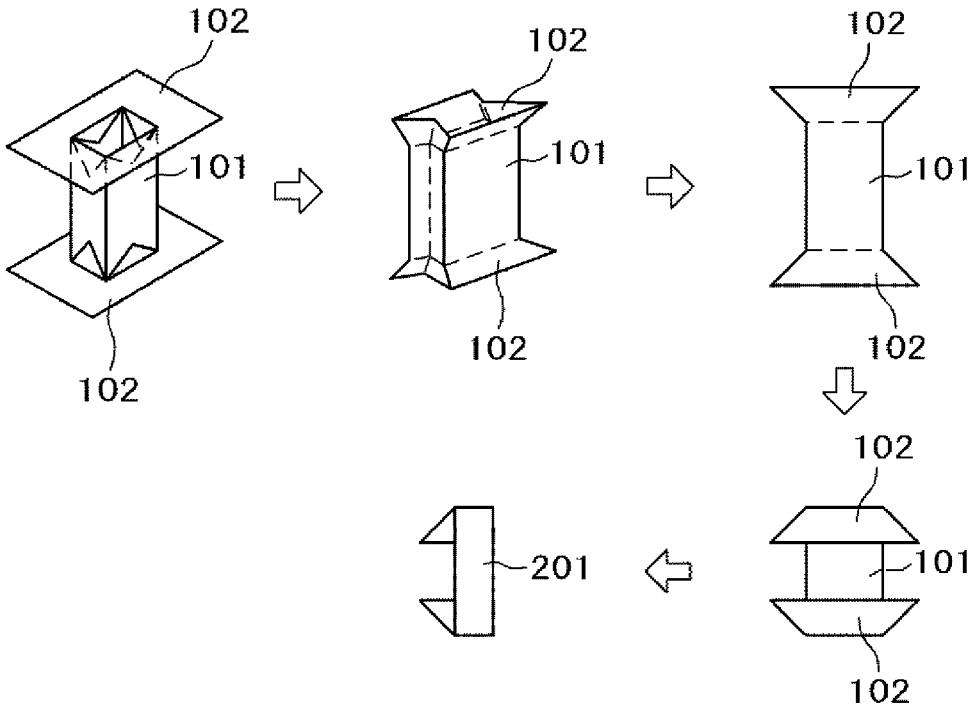
FIG. 1B illustrates how to fold the insulating member of FIG. 1A.
Figure 2:
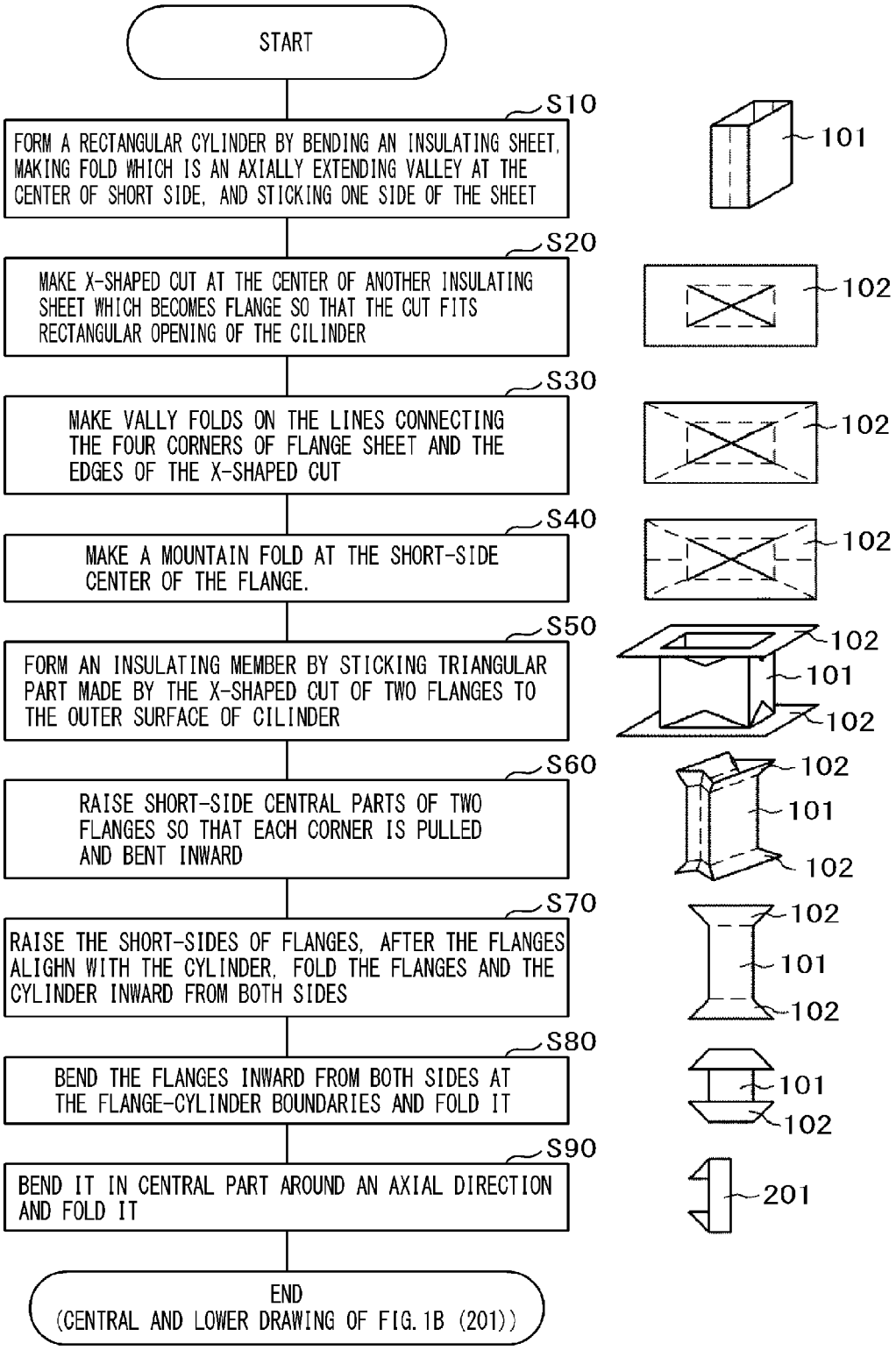
FIG. 2 is a flowchart indicating the folding order of the insulating member of FIG. 1B.

FIG. 1B illustrates how to fold the insulating member 100 formed in FIG. 1A. FIG. 1B illustrates the insulating member formed by the folding process of the insulating member 100. From the left drawing of FIG. 1B, the rectangular cylinder and the flanges of the insulating member are folded inward at the center, resulting in the drawing at the top center. The insulating member is further folded in the center line into the substantially toppled U shape shown at the right drawing of FIG. 1B. The folding method of FIG. 1B is described in detail below with reference to the flowchart of FIG. 2. FIG. 2 illustrates the flowchart of folding method of the insulating member. At first, a rectangular cylinder of the insulating member is formed by bending a rectangular insulating sheet, making valley fold which is an axially extending valley at the center of short side, and sticking the paste margin made for one side of the sheet. (Step 10) Next, X-shaped cut is made at the center of another insulating sheet which becomes flange so that the cut fits rectangular opening of the cylinder. (Step 20) Then, valley folds are made on the lines connecting the four corners of the flange and the edges of the x-shaped cut. (Step 30) Next, mountain folds are made at the short-side center of the flange. (Step 40) Then, an insulating member is formed by applying an adhesive (e.g., epoxy adhesive) to the four triangular flaps made by the X-shaped cut, and sticking to the surface of the cylinder. (Step 50) Next, the short-side central sections of each flange are raised so that each flange corner is pulled and folded inward. (Step 60) Then, the short-sides of flanges are raised, after the flanges align with the cylinder, the flanges and the cylinder are folded inward from both sides and flattened. (Step 70) Next, the flanges are bent inward from both sides at the flange-cylinder boundaries and folded. Finally, the insulating member is folded along a line being in a symmetrical position and parallel to the axial direction, resulting in a substantially toppled U shape. (Step 90) Steps S10 to S90 allow easy insertion of the insulating member into the hole of a coil. It should be noted that if the insulating member can be inserted into a coil after Step S80, Step S90 can be skipped.

Figure 1C:
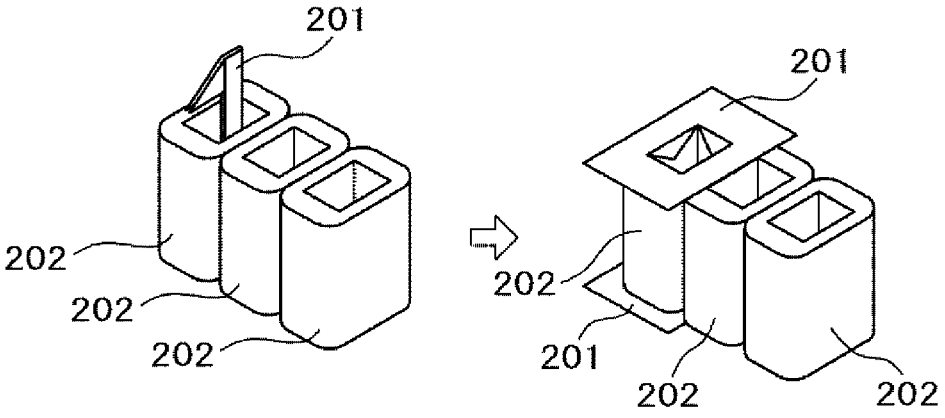
FIG. 1C shows the folded insulating member of FIG. 1B being inserted into a coil and expanded.
Figure 3A:
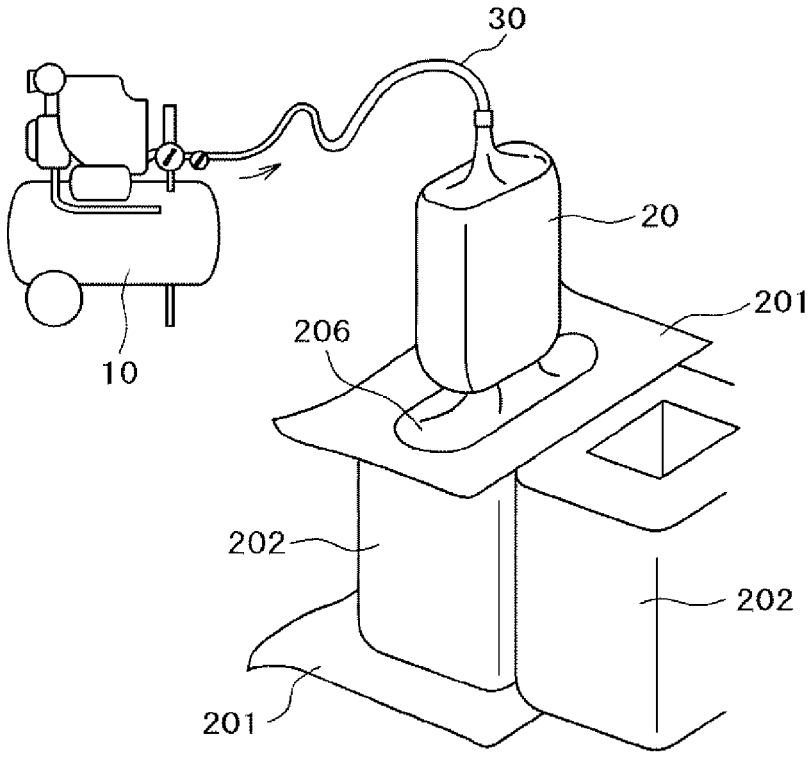
FIG. 3A illustrates a method for inserting an airbag into the cylinder of an insulating member placed within a coil and expanding the airbag and the cylinder.
Figure 3B:
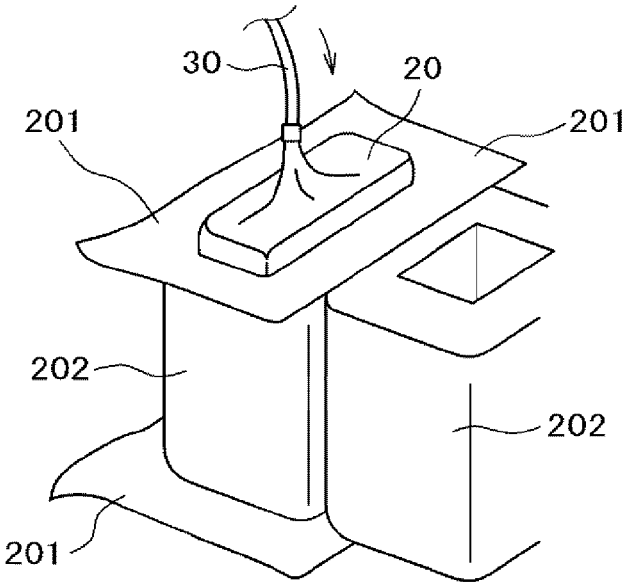
FIG. 3B illustrates a method for inserting an airbag into the cylinder of an insulating member placed within a coil and expanding the airbag and the cylinder.

FIG. 1C illustrates the process of inserting the insulating member folded nearly toppled-U-shaped into the hole of a coil and expanding it. The left drawing in FIG. 1C shows the folded insulating member being inserted into the hole of the coil, and the right drawing shows the inserted insulating member being expanded within the hole of the coil. Note that FIG. 1C illustrates an example of a three-phase three-leg core transformer. FIGS. 3A and 3B illustrate one Example of a detailed method of expanding the folded insulating member within the coil. In FIGS. 3A and 3B, reference numerals 10, 20, and 30 represent an air compressor, an airbag which swells out with air, and an air feed tube, respectively. FIG. 3A shows the state in which the folded insulating member is inserted into the hole of the coil, and the cylinder of the insulating member is expanded in advance, and the airbag 20 (not expanded) being about to be inserted into the expanded cylinder. FIG. 3B shows the state in which the airbag 20 is expanded with the air. In FIG. 3A, the airbag 20 is inserted into the coil after an enough space is secured by expanding the flanges and cylinder of the inserted insulating member.

The airbag 20 is made of a soft material or a material without surface irregularities so as to prevent damage to the insulating member. Examples include rubber materials, plastic materials, and cloth materials. After the airbag 20 is inserted into the cylinder of the insulating member within the hole of the coil, compressed air is fed from the air compressor 10 through the tube 30 to the airbag 20. In FIG. 3B, the airbag 20 is expanded with the compressed air from the air compressor 10. When the airbag 20 is expanded inside the coil, the cylinder of the insulating member is pressed against the interior of the coil. The expansion of the airbag 20 is continued for a certain amount of time. After full expansion of the insulating member within the hole of the coil, the airbag 20 is shrunk and pulled out of the coil. The above method of expanding the cylinder of the insulating member is only meant to be an example. Alternatively, a nozzle can be attached to the tube 30 in place of the airbag 20, and air can be sprayed onto the interior of the cylinder of the insulating member in order to expand it.

Figure 1D:
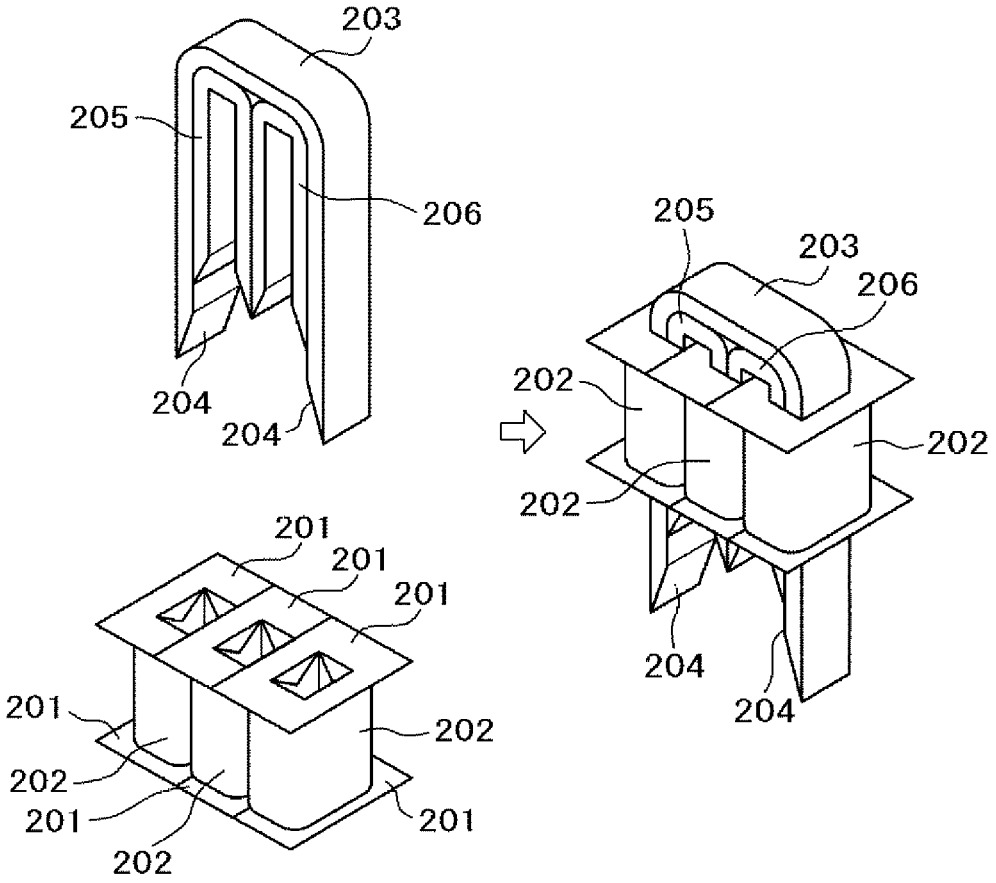
FIG. 1D illustrates how to insert an open-ended amorphous core into the insulating member of FIG. 1C placed within the coil.
Figure 1E:
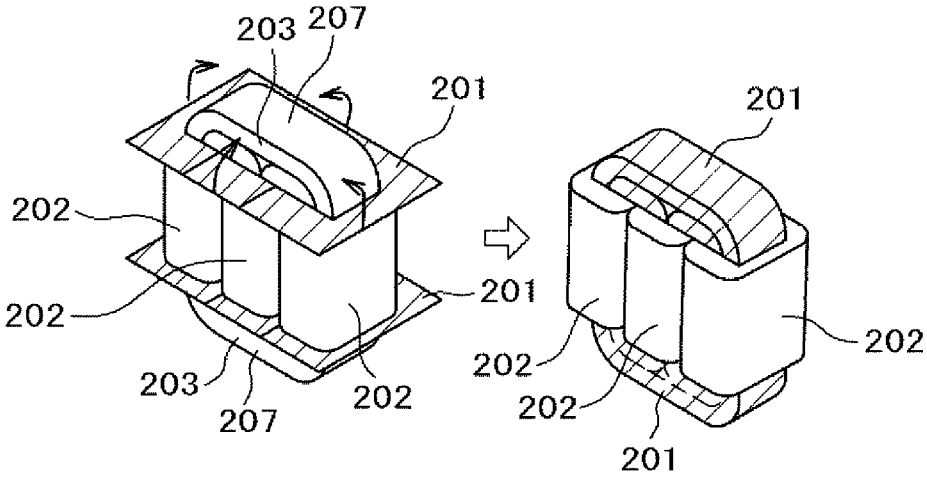
FIG. 1E illustrates states in which the amorphous core is inserted into the insulating members of FIG. 1D, the disconnected amorphous core is lapped, and then the yokes of the core is covered with the flanges of the insulating members.

FIG. 1D illustrates part of the assembly process in which an amorphous core is inserted into coils. In FIG. 1D, the amorphous core 203 is a three-phase five-leg transformer core with inner and outer cores. As illustrated by the left drawing in FIG. 1D, the amorphous core 203 is inserted from above into insulating members 201 set within the coils 202, with its joint section being disconnected (i.e., at this point, the amorphous core 203 has an inverted U shape). The right drawing in FIG. 1D illustrates the amorphous core 203 being inserted into the insulating members 201 of the coils. The assembly process further proceeds to FIG. 1E from FIG. 1D. As illustrated in FIG. 1E, after the amorphous core 203 is inserted into the insulating members 201 set within the coils, the joint section of the core 203 are lapped to form a closed loop. After that, the yokes 207 of the amorphous core are then covered with each of the flanges of the insulating members, and by bending the flanges along the yokes 207, the yokes are wrapped without a gap like FIG. 1E. In Example 1, the entire amorphous core is wrapped with the insulating members. Thus, the insulating members prevent the scattering of amorphous fragments.

Example 2

Figure 4:
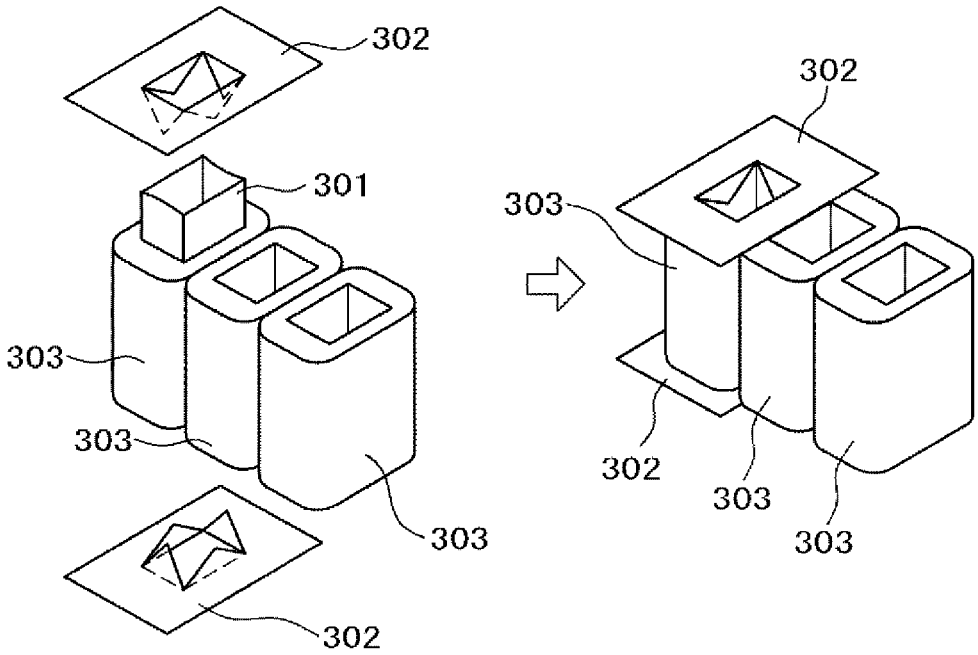
FIG. 4 illustrates an assembly method according to Example 2 of the invention for putting an amorphous core and coils together.

Next, an assembling method of an amorphous core and coils according to Example 2 of this invention will be described using FIG. 4. FIG. 4 is a figure indicating the assembling method of the amorphous core and coils according to Example 2. As illustrated in FIG. 4, a rectangular cylinder and two flanges are prepared to form an insulating member. An x-shaped cut is made on each of the flanges such that the cut fits within the opening of the cylinder, and the resultant triangular flaps of the flange are raised. An adhesive is then applied to the triangular flaps in order to stick and adhere to the end face of the cylinder. As adhesive, Epoxy based adhesive with the heat resistance is used. First, a rectangular cylinder is inserted into the hole of a coil. Atop portion of the cylinder is pulled out from the hole of the coil so that the flange can be stuck easily, and one of the flanges is stuck and adhered to the outer surfaces of the cylinder. Thereafter, the coil is inverted to adhere the other flange to the other side of the cylinder, and the triangular flaps of the other flange are stuck and adhered to the inner surface of the cylinder. After the two flanges are stuck to both side of the cylinder, the coil is inverted again, resulting in the right drawing in FIG. 4. As illustrated by the right drawing in FIG. 4, the triangular flaps of the top-side flange are stuck to the inner surfaces of the cylinder while the triangular flaps of the bottom-side flange are stuck to the outer surfaces of the cylinder. This allows an open-ended amorphous core to be inserted smoothly into the coil because the internal steps resulting from the stuck triangular flaps are downward steps when viewed from the direction of amorphous core insertion (i.e., the thickness of the cylinder becomes smaller in the direction of amorphous core insertion). Though not illustrated, the triangular flaps of the tops-side flange can instead be stuck to the outer surfaces of the cylinder. In this case as well, the insertion of the amorphous core is not impeded. The assembly process after FIG. 4 is the same as in FIGS. 1D and 1E.

Example 3

Figure 5A:
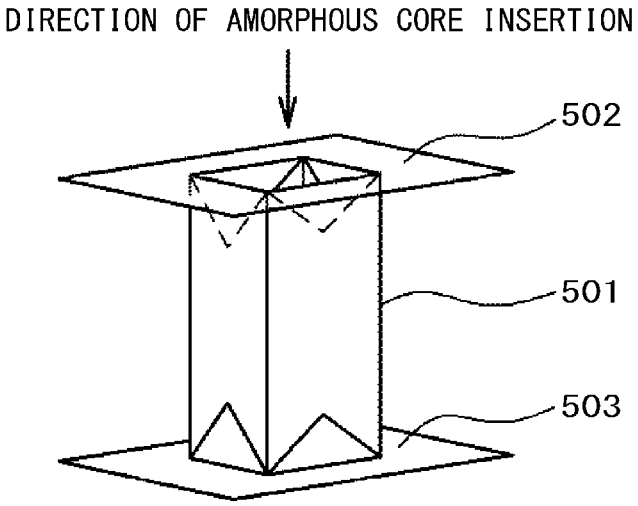
FIG. 5A illustrates structurally different insulating members according to an example of the invention.

Next, an insulating member according to an example of this invention will be described using FIGS. 5A and 5B. FIG. 5A illustrates an insulating member formed by sticking two flanges to the both ends of a rectangular cylinder. An x-shaped cut is made in the center of the flange at the cylinder end through which the amorphous core is inserted, and the resultant triangular flaps are stuck and adhered to the outer surfaces of the cylinder. Likewise, an x-shaped cut is made in the center of the flange at the cylinder end from which the amorphous core comes out, and the resultant triangular flaps are stuck and adhered to the outer surfaces of the cylinder. As already stated above, this structure allows smooth insertion of an amorphous core into the cylinder of the insulating member without resistance.

Figure 5B:
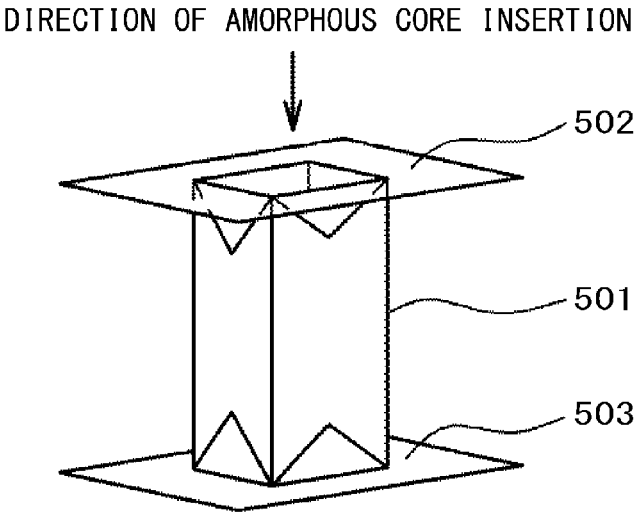
FIG. 5B illustrates structurally different insulating members according to an example of the invention.

FIG. 5B illustrates another insulating member formed by sticking and adhering two flanges to the both ends of a rectangular cylinder. An x-shaped cut is made in the center of the flange disposed at the amorphous core inserting side, and the resultant triangular flaps are stuck and adhered to the inner surfaces of the cylinder. Likewise, an x-shaped cut is made in the center of the flange disposed at the amorphous core exiting side, but the resultant triangular flaps are stuck and adhered to the outer surfaces of the cylinder. This structure also allows smooth insertion of an amorphous core into the cylinder of the insulating member because the internal steps resulting from the stuck triangular flaps are downward steps when viewed from the direction of amorphous core insertion (i.e., the thickness of the cylinder becomes smaller in the direction of amorphous core insertion).

Figure 6:
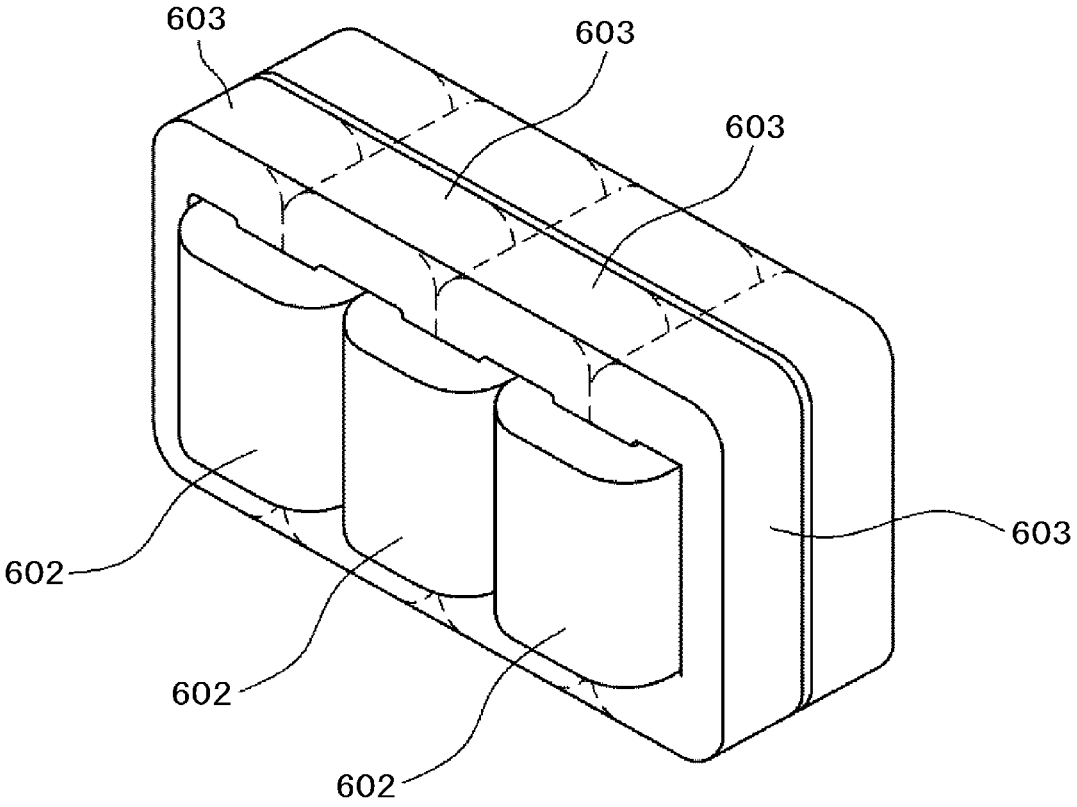
FIG. 6 illustrates the structure of a three-phase five-leg core.

The foregoing description is based on the assumption that the insulating members of the present invention are applied to three-phase three-leg cores. It should be noted however that the invention can be applied to single-phase single-leg cores as well. Moreover, as illustrated in FIG. 6, the invention can be applied to three-phase five-leg cores in which multiple amorphous cores are arranged next to one another. In FIG. 6, reference numerals 602 and 603 represent coils and amorphous cores, respectively.

REFERENCE SIGNS LIST

10 . . . Air compressor
20 . . . Airbag
30 . . . Tube
101, 301, 501 . . . Cylinder of insulating member
102, 302, 502, 503 . . . Flange of insulating member
103 . . . Insulating member
201 . . . Folded insulating member
202, 303, 602 . . . Coil
203, 603 . . . Outer amorphous core
205, 206 . . . Inner amorphous core
204 . . . Lapped portion
207 . . . Yoke

The invention claimed is:

1. A method for assembling an insulating member, an amorphous core, and a coil of an amorphous core transformer, the insulating member having a rectangular cylinder and flanges and having a first dimension, the amorphous core having a joint section, and the coil having a hole, wherein the method comprises:

folding the rectangular cylinder and flanges of the insulating member, the folded insulating member having a second dimension smaller than the first dimension;

inserting the folded insulating member into the hole of the coil;

expanding the rectangular cylinder and the flanges of the folded insulating member;

disconnecting the joint section of the amorphous core;

inserting an open-ended portion of the amorphous core into the rectangular cylinder of the expanded insulating member within the coil;

lapping the disconnected joint section of the amorphous core; and covering yokes of the amorphous core with the flanges of the insulating member.

2. The method of claim 1, wherein each of the flanges has at a center thereof an x-shaped cut fitting within an opening of the rectangular cylinder, and further comprising adhering resultant triangular flaps to both ends of the rectangular cylinder.

3. The method of claim 2, wherein the triangular flaps of the flange disposed on the side through which the amorphous core is inserted are stuck to inner or outer surfaces of the rectangular cylinder, while the triangular flaps of the flange disposed on the side from which the amorphous core comes out are stuck to the outer surfaces of the rectangular cylinder.

4. The method of claim 2, wherein the step of folding further comprises:

making a valley fold at each of the short-side centers of the rectangular cylinder such that both parts adjacent to the valley fold are folded in a direction perpendicular to an axial direction of the rectangular cylinder;

making a valley fold at each of the short-side centers of the flanges, and flattening the cylinder and the flanges;

bending the flanges disposed at both ends inward; and folding the rectangular cylinder and the flanges along a line being in a symmetrical position.

5. The method of claim 1, wherein the step of expanding the rectangular cylinder of the folded insulating member in the core of the coil comprises:

inserting an airbag into the rectangular cylinder; and expanding the airbag by feeding air to the airbag, thereby making the cylinder.

* * * * *